United States Patent [19]

Miller

[11] Patent Number: 5,019,007

[45] Date of Patent: May 28, 1991

[54] TOY GLIDER WITH VARIABLE DIHEDRAL WINGS

[76] Inventor: Jack V. Miller, 700 N. Auburn Ave., Sierra Madre, Calif. 91024

[21] Appl. No.: 551,243

[22] Filed: Jul. 9, 1990

[51] Int. Cl.[5] ..... A63H 27/00

[52] U.S. Cl. ..... 446/62; 401/66

[58] Field of Search ..... 446/62, 66, 67, 61, 446/64, 68

[56] References Cited

U.S. PATENT DOCUMENTS

| | | | |
|---|---|---|---|
| 3,222,817 | 12/1965 | Brandstetter | 446/62 |
| 4,135,718 | 1/1979 | Loewy | 446/62 |
| 4,759,736 | 7/1988 | Carlson | 446/62 |
| 4,863,412 | 9/1989 | Milhalinec | 446/66 |

*Primary Examiner*—Richard J. Johnson

[57] ABSTRACT

A toy glider has an elongated fuselage including a nose section and a tail empennage section, an elongated, recessed wing mounting channel on each side of the flight axis including a female, V-shaped bottom for receiving a pair of wings. Each wing has a wing root in the form of an elongated polygon having male corners matching the V-bottom channel of the fuselage. A tension means, such as an elastic band, urges each wing root into a mating engagement with the wing root channel of the fuselage, whereby the tension means may be manually overcome to disengage wing root and permit movement of either wing in a vertical direction from the horizontal plane. In a preferred embodiment one male corner of the wing root as an upstanding rib matching an elongated groove in the V-bottom of the fuselage channel, providing a positive position for the wing in a flight configuration. A preferred embodiment provides separate, manually movable inboard and outboard wing sections which permit the wings to be configured as planar wings, gull wings, inverted gull wings or substantially folded gull wings.

8 Claims, 12 Drawing Sheets

17
17a
16
16a
2
14
14a
18
18a
24
24a
26
26a
22
22a
27
25
28a
35
35a
37
37a
32
32a
34
34a
36
36a
20
20a
19
19a
A
1

TOY GLIDER WITH VARIABLE DIHEDRAL WINGS

BACKGROUND OF THE INVENTION

This invention relates to toy gliders, and more specifically to reconfigurable toy gliders that may be transformed into a variety of configurations, such as shown in my co-pending applications Ser. No. 331,774 entitled RECONFIGURABLE ANIMAL FIGURE TOY GLIDER, Ser. No. 512,769 entitled RECONFIGURABLE TOY GLIDER, and other co-pending applications; TOY FOAM PLASTIC GLIDER WITH FLEXIBLE APPENDAGES and TOY FOAM PLASTIC GLIDER WITH DETACHABLE PYLON WINGS.

A primary purpose of the present invention is to provide a toy glider that is reconfigurable into various types of wings and thereby provide enhanced play value for a toy glider. The invention expands a limited-use glider into a reconfigurable glider that may be used in play that extends to the limits of a child's imagination.

SUMMARY OF THE INVENTION

A toy glider according to the invention has an elongated fuselage including a nose section and a tail empennage section and having a longitudinal flight axis at the intersection of a vertical plane and a horizontal plane when said toy glider is in a normal horizontal flight attitude. The fuselage has an elongated, recessed wing mounting channel on each side of the flight axis including a female, V-shaped bottom, a pair of generally planar wings, each wing having a wing root in the form of a polygonal form having a male corner generally matching the angle, width and length of the respective V-bottom channel of the fuselage.

A tension member, such as an elastic band or extension spring urges each wing root into a mating engagement with a respective wing root channel of the fuselage, whereby the tension means may be manually overcome to disengage the male polygonal corner from its mating engagement into the V-shaped channel of the fuselage and permit movement of either wing in the vertical direction from the horizontal plane.

Each wing root polygonal form has a plurality of male corners, each generally matching the angle, width and length of a respective V-bottom channel of the fuselage. The first male polygonal corner is in mating engagement into the V-shaped channel of the fuselage with the wing being generally in the horizontal plane, and other male polygonal corners are in engagement into the channel with the wing having negative dihedral below the horizontal plane or positive dihedral above the horizontal plane. In a preferred embodiment the second male polygonal corner is provided with a male rib that engages into a slot at the apex of the V-shaped bottom of the fuselage recess, providing a locked wing orientation in the horizontal plane.

In another preferred embodiment each wing has an outboard wing section and an inboard wing section. Each inboard wing section has a wing root at the inboard end in the form of a polygonal form having at least one male corner generally matching the angle, width and length of the respective V-bottom channel of the fuselage, and each inboard wing section has an outboard end having an elongated, recessed channel on the outboard end including a female, V-shaped bottom. Each outboard wing section has a wing root at the inboard end in the form of a polygonal form having at least one male corner generally matching the angle, width and length of the respective V-bottom channel of the outboard end of the inboard wing section.

Each wing root polygonal member has a tension means urging the wing root into a mating engagement with a respective wing root channel, whereby the tension means may be manually overcome to disengage the male polygonal corner from its mating engagement into the V-shaped channel and permit movement of the wing section upwards or downwards in the vertical direction.

The preferred embodiments provide wing root polygonal corners to permit inboard sections of both wings to be manually moved to several possible flight configurations at or near the horizontal plane and to permit the complete wings, or the inboard and outboard separate sections of both wings to be manually moved to angles substantially above or below the normal normal flight configurations.

DETAILED DESCRIPTION OF THE DRAWINGS

Figure 1:
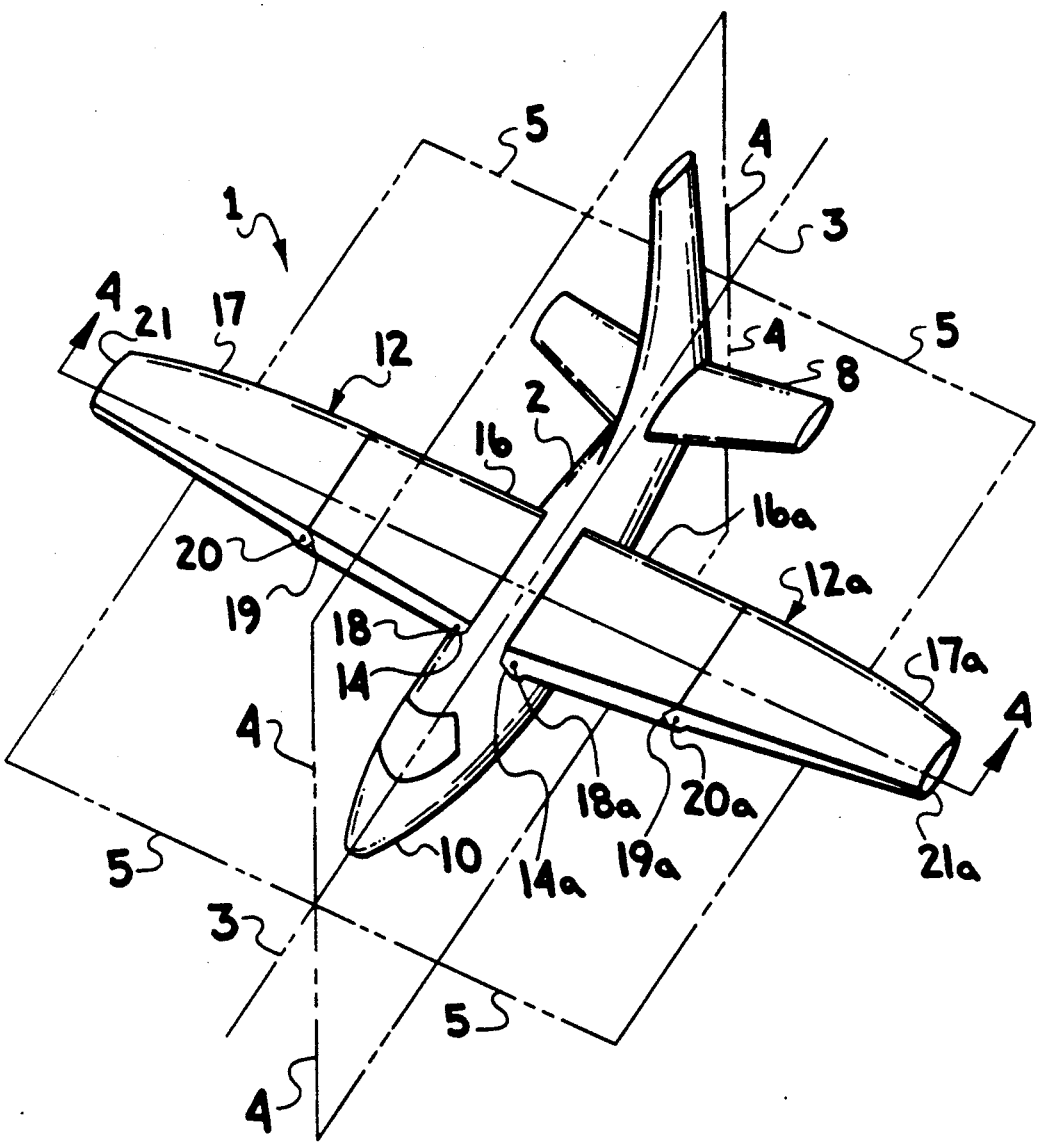
FIG. 1 is a perspective view of a toy glider according the invention, showing the wings in a normal flight configuration in the horizontal plane.

In FIG. 1 the toy glider 1 is shown having a fuselage 2 having a longitudinal flight axis 3 at the intersection of a vertical plane 4 and a horizontal plane 5. Fuselage 2 includes a tail empennage 8 and a nose section 10 and has wings 12 and **12*a* transverse to the longitudinal axis and generally in the horizontal plane, the wings having inboard wing sections 16 and 16*a*, and outboard wing sections 17 and 17*a*, respectively, shown in a normal flight configuration in the horizontal plane. Fuselage 2** is also provided with a recessed wing root mounting channels 14 and 14a in the fuselage on each side of the flight axis which movably retain inboard wing section roots 18 and 18a, respectively. Inboard wing sections 16 and 16a have outboard ends including recessed wing root mounting channels 19 and 19a, respectively. Outboard wing sections 17 and 17a have outboard section wing tips 21 and 21a, and wing roots 20 and 20a engaged into and movably retained by inboard section channels 19 and 19a, respectively.

Figure 2:
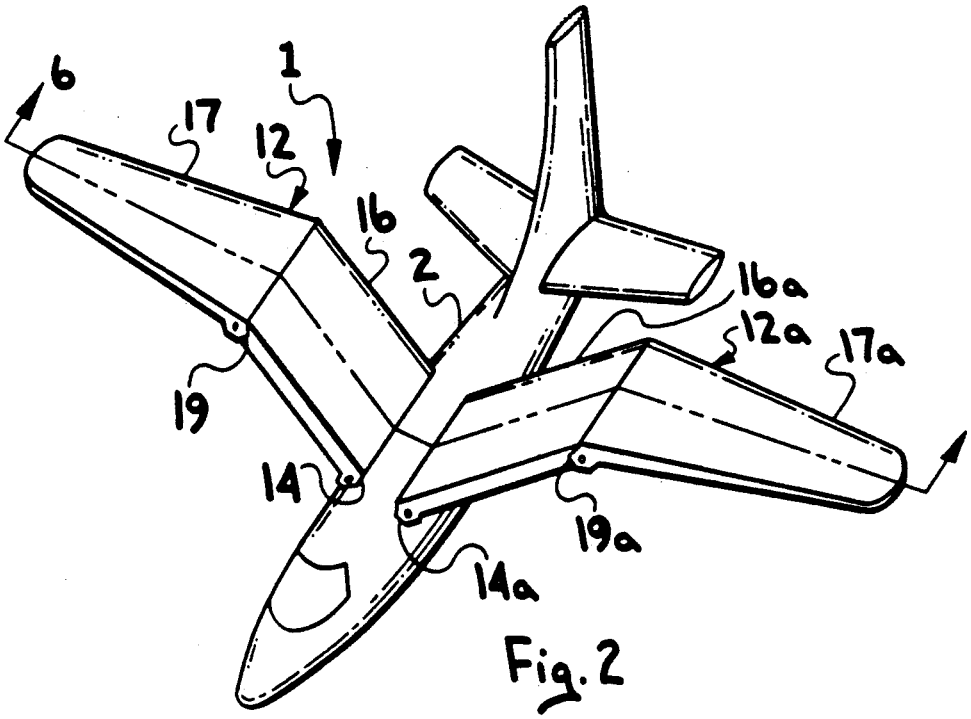
FIG. 2 is a perspective view of the glider of FIG. 1, showing the wings reconfigured into a gull-wing flight configuration.

In FIG. 2 the toy glider 1 is shown including a fuselage 2 having a longitudinal flight axis 3. Fuselage 2 has wings 12 and 12a transverse to the longitudinal axis and generally in a "gull-wing" configuration with the inboard wing sections 16 and 16a moved upwards to positive dihedral in the recessed wing root mounting channel 14 and 14a in the fuselage, and outboard wing sections 17 and 17a, respectively, moved downwards in the recessed wing root mounting channel 19 and 19 of the inboard wing section, positioning the outboard wing sections 17 and 17a, respectively, to a zero dihedral horizontal position.

Figure 3:
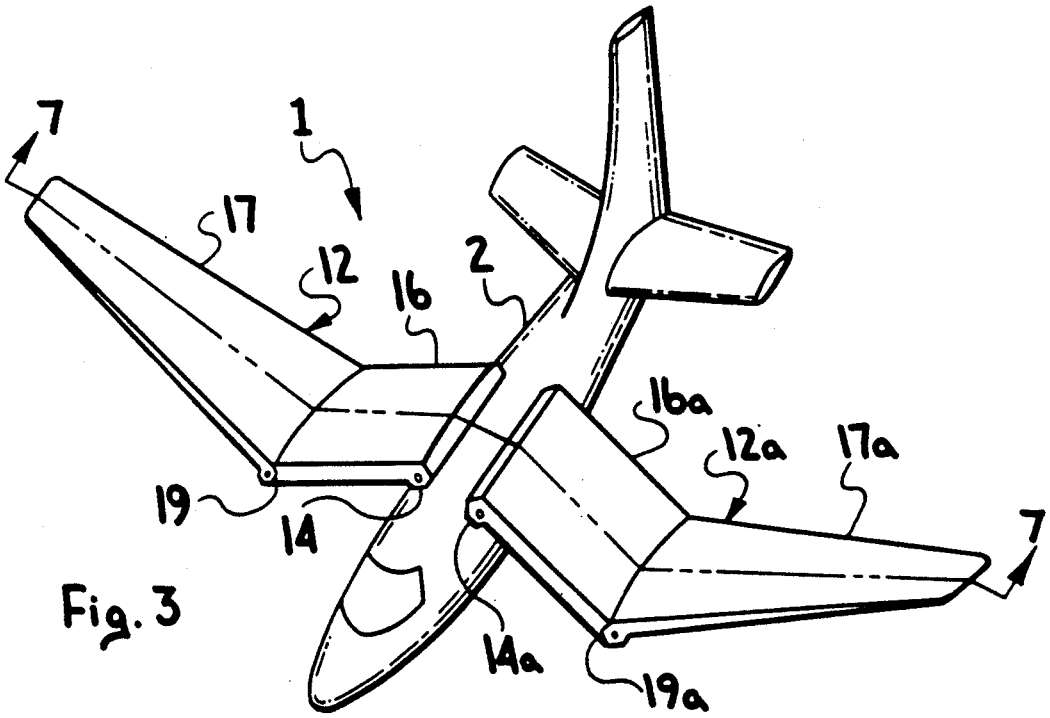
FIG. 3 is a perspective view of the glider of FIG. 1, showing the wings reconfigured into an inverted gull-wing flight configuration.

FIG. 3 the toy glider 1 is shown including a fuselage 2 having a longitudinal flight axis 3. Fuselage 2 has wings 12 and 12a transverse to the longitudinal axis and generally in an "inverted gull-wing" configuration with the inboard wing sections 16 and 16a moved downwards to negative in the recessed wing root mounting channel 14 and 14a in the fuselage, and outboard wing sections 17 and 17a, respectively, moved upwards in the recessed wing root mounting channel 19 and 19 of the inboard wing sections 16 and 16a, respectively, moving the outboard wing sections 17 and 17a, respectively, to a positive dihedral position.

Figures 4, 5, 6, 7:
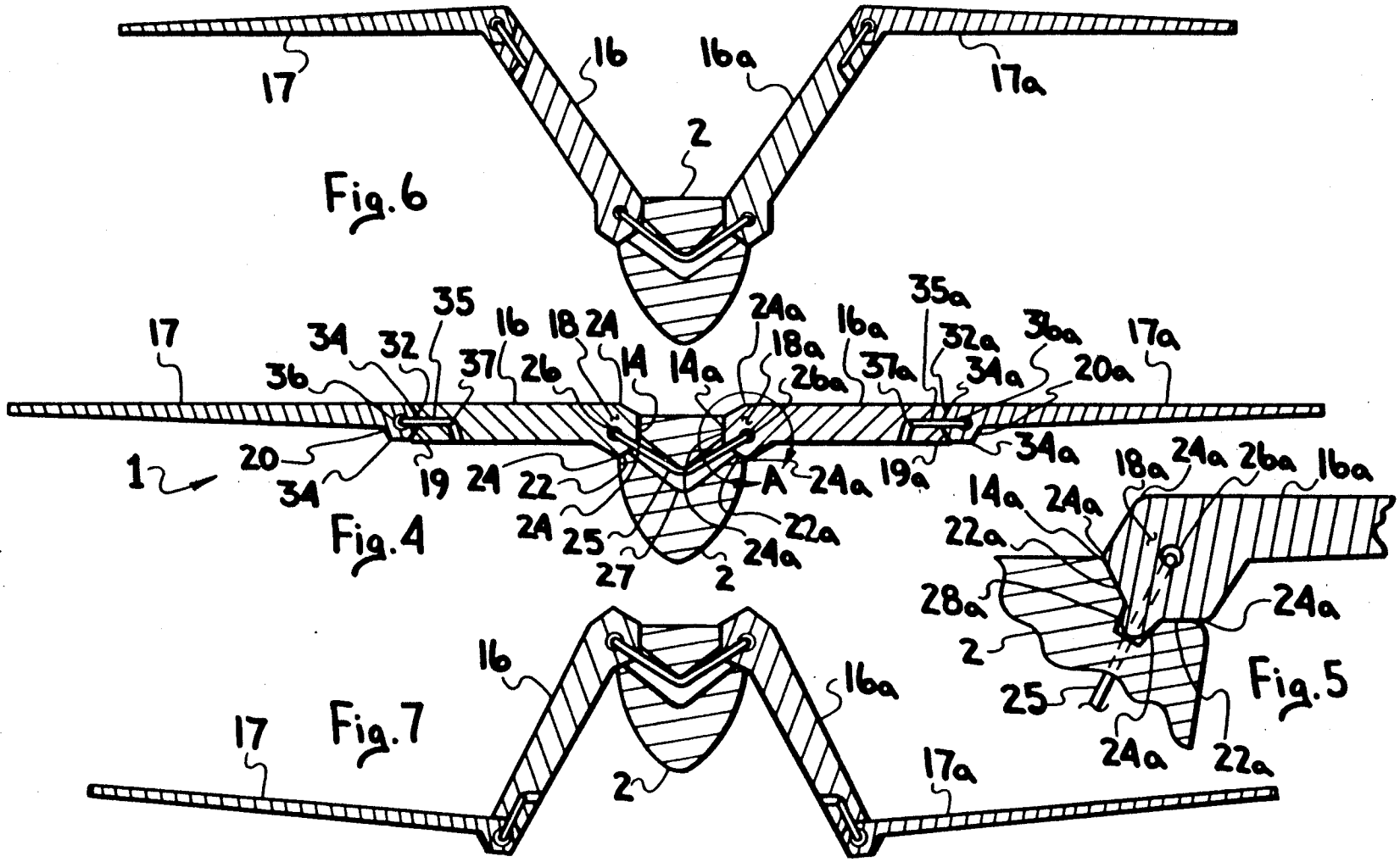
FIG. 4 is a cross-sectional view of the glider of FIG. 1, taken along section line 4—4.
FIG. 5 is an enlarged cross-sectional view of a portion of FIG. 4 and showing an alternate preferred embodiment.
FIG. 6 is a cross-sectional view of the glider of FIG. 2, taken along section line 6—6.
FIG. 7 is a cross-sectional view of the glider of FIG. 3, taken along section line 7—7

In FIG. 4 across-sectional view of the glider of FIG. 1, taken along section line 4—4 of FIG. 1, shows the inboard wing sections 16 and 16a engaged into respective fuselage recessed wing root mounting channels 14 and 14a of fuselage 2. Channels 14 and 14a are each in the form of an elongated channel having a generally V-shaped bottom 22 and 22a, respectively. Wing roots 18 and 18a are in the form of an elongated polygonal shape having a plurality of male corners 24 and 24a, matingly engaged into respective V-bottoms 22 and 22a of fuselage 2. A tension member 25 is attached to an anchor hole 26 of wing root 18, passes through an aperture 27 in fuselage 2, and attaches to an anchor hole 26a of wing root 18a, urging wing root 18 into mating engagement with channel 22 and wing root 18a into mating engagement with channel 22a, with inboard wing section 16 and 16a retained thereby in the horizontal plane.

The figure also shows wing roots 20 and 20a of outboard wing sections 17 and 17a engaged into wing root mounting channels 19 and 19a of inboard wings section 16 and 16a, respectively. Channels 19 and 19a are each in the form of an elongated channel having a generally V-shaped bottom 32 and 32a, respectively. Wing roots 20 and 20a are in the form of an elongated polygonal shape having a plurality of male corners 34 and 34a, matingly engaged into respective V-bottoms 19 and 19a of inboard wing section 17 and 17a, respectively. Tension members 35 and 35a are attached to anchor hole 36 and 36a of wing root 17 and 17a, respectively, and connecting to anchor point 37 and 37a in inboard wing sections 16 and 16a, respectively, urging wing roots 20 and 20a, into mating engagement with channels 19 and 19a, respectively, thereby retaining outer wing section 17 and 17a, respectively in the horizontal plane.

In FIG. 5, which is an enlarged cross-sectional view at view A of FIG. 4, showing an alternate preferred embodiment of wing root 18a of inboard wing section 16a, urged into engagement with channel 22a of fuselage 2 by tension member 25, secured at anchor 26a. The polygonal form of wing root 18a is shown having a plurality of male corners 24a, one of which is provided with an upstanding rib 27 engaged into channel 28 in fuselage 2, whereby the wing root 18a must be pulled out of engagement with fuselage channel 14a in order to rotate the wing root 18a to move another male corner 24a into engagement with the V-shaped botton 22a of channel 14a. One or more of the male corners 24a may be slightly radiused to facilitate rotation of the wing root 18a in channel 14a.

In FIG. 6 the components of FIG. 4 are shown reconfigured by rotating inboard wing sections 16 and 16a upwards from horizontal to a gull-wing configuration in which sections 16 and 16a have positive dihedral and outboard wing sections 17 and 17a are rotated to the horizontal plane with substantially zero dihedral angle.

Figure 8:
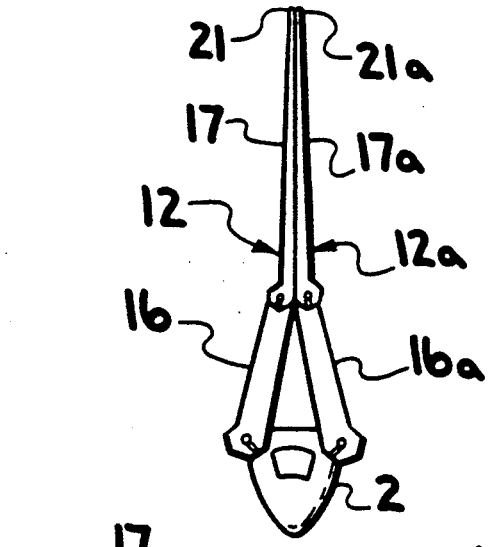
FIG. 8 is a front elevation view of a glider according to the invention, showing a first non-flight wing configuration.

In FIG. 7 the components of FIG. 4 are shown reconfigured by rotating inboard wing sections 16 and 16a downwards from horizontal to an inverted gull-wing configuration in which sections 16 and 16a have negative dihedral and outboard wing sections 17 and 17a are rotated above the horizontal plane to a positive dihedral angle. In FIG. 8 the components of FIG. 4 are shown further reconfigured by rotating the complete wings 12 and 12a fully upwards from horizontal to a vertical configuration.

Figure 9:
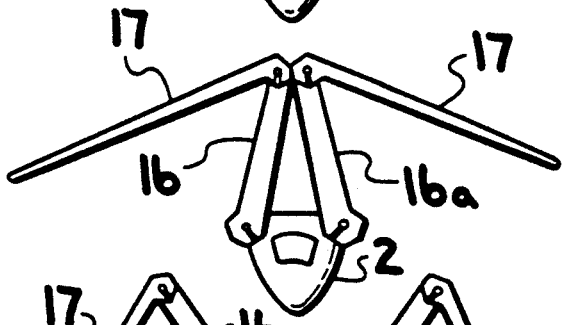
FIG. 9 is a front elevation view of a glider according to the invention, showing a second non-flight wing configuration.

In FIG. 9 the components of FIG. 4 are shown reconfigured by rotating inboard wing sections 16 and 16a fully upwards from horizontal to a vertical position and rotating outboard wing sections 17 and 17a to a position below the horizontal plane to a negative dihedral angle.

Figure 10:
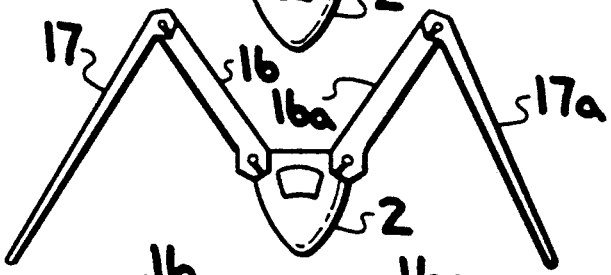
FIG. 10 is a front elevation view of a glider according to the invention, showing a third non-flight wing configuration.

In FIG. 10 the components of FIG. 4 are shown reconfigured by rotating inboard wing sections 16 and 16a upwards from horizontal to a positive dihedral angle and rotating outboard wing sections 17 and 17a to a position below the horizontal plane to an extreme negative dihedral angle.

Figure 11:
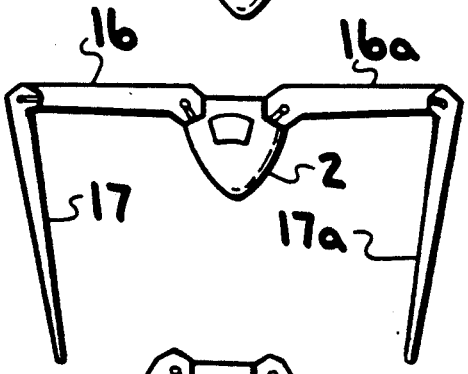
FIG. 11 is a front elevation view of a glider according to the invention, showing a fourth non-flight wing configuration.

In FIG. 11 the components of FIG. 4 are shown maintaining inboard wing sections 16 and 16a in the horizontal plane and fully rotating outboard wing sections 17 and 17a downwards to a depending vertical orientation.

Figure 12:
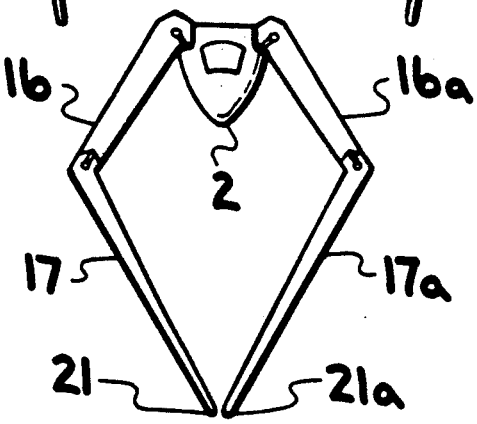
FIG. 12 is a front elevation view of a glider according to the invention, showing a fifth non-flight wing configuration.

In FIG. 12 the components of FIG. 4 are shown reconfigured by rotating inboard wing sections 16 and 16a fully downwards from horizontal to an extreme negative dihedral angle and rotating outboard wing sections 17 and 17a to a position below the horizontal plane where the respective wing tips 21 and 21a are touching or proximate.

I claim:

1. A toy glider comprising:

an elongated fuselage including a nose section and a tail empennage section, said fuselage having a longitudinal flight axis at the intersection of a vertical plane and a horizontal plane when said toy glider is in a normal horizontal flight attitude, the fuselage having an elongated, recessed wing mounting channel on each side of the flight axis including a female, V-shaped bottom;

a pair of generally planar wings transverse to the longitudinal axis and generally in the horizontal plane, each wing having an outboard wing section and an inboard wing section;

an inboard wing section of each wing having a wing root at the inboard end in the form of an elongated polygon having at least one male corner generally matching the angle, width and length of a respective V-bottom channel of the fuselage, and having an outboard end including an elongated, recessed channel with a female, V-shaped bottom;

an outboard wing section of each wing having a wing root at the inboard end in the form of a polygonal form having at least one male corner generally matching the angle, width and length of the respective V-bottom channel of the outboard end of the inboard wing section, and each outboard wing section including a wing tip at an outboard end;

a tension means urging the wing root of each inboard wing section into a mating engagement with the respective wing root channel of the fuselage, whereby the tension means may be manually overcome to disengage the male polygonal corner from its mating engagement into the V-shaped channel of the fuselage and permit movement of the inboard wing section in the vertical direction; and a tension means urging its wing root of each outboard wing section into a mating engagement with a respective wing root channel of the respective inboard wing section, whereby the tension means may be manually overcome to disengage the male polygonal corner from its mating engagement into the V-shaped channel of the inboard wing section and permit movement of the outboard wing section in the vertical direction.

2. A toy glider according to claim 1 in which the wing root polygon of each inboard and outboard wing section has a plurality of male corners, each generally matching the angle, width and length of a respective V-bottom channel, and each said wing root polygon has a tension means urging it into mating engagement with a respective wing root channel, whereby the tension means may be manually overcome to disengage said male polygonal corner from its mating engagement into said V-shaped channel to manually disengage one male polygonal corner and to engage another male polygonal corner.

3. A toy glider according to claim 2 in which:

a first male polygonal corner of the inboard wing section positions said inboard wing section approximately in the horizontal plane and a first male polygonal corner of the outboard wing section positions said outboard wing section in the same plane as said inboard wing section, whereby the wing has generally no dihedral angle with respect to the fuselage;

at least one additional male polygonal corner of the inboard wing section positions said inboard wing section at an angle above the horizontal plane, whereby said inboard wing section has substantially positive dihedral with respect to the fuselage;

at least one additional male polygonal corner of the inboard wing section positions said inboard wing section at an angle below the horizontal plane, whereby the inboard wing section has substantially negative dihedral with respect to the fuselage;

at least one additional male polygonal corner of the outboard wing section positions said outboard wing section at an angle above the plane of the respective inboard wing section, whereby said outboard wing section has substantially positive dihedral with respect to the the respective inboard wing section; and at least one additional male polygonal corner of the outboard wing section positions said outboard wing section at an angle below the plane of the respective inboard wing section, whereby said outboard wing section has substantially negative dihedral with respect to the the respective inboard wing section.

4. A toy glider according to claim 3 in which the wings may be manually re-positioned from a generally horizontal planar flight configuration to a gull-wing flight configuration having positive dihedral inboard wing sections and horizontal outboard wing sections, or to an inverted gull-wing flight configuration having negative dihedral inboard wing sections and positive dihedral outboard wing sections.

5. A toy glider according to claim 3 in which at least the first male polygonal corner of each wing root polygon has a raised male rib having a base at the apex of said polygonal corner and a pair of substantially parallel sides extending to a top rib surface, said rib closely matching a mating channel provided at the apex of the respective mating V-bottom channel, whereby the wing root must be transversely pulled a sufficient distance to disengage the rib from the mating channel to permit re-positioning of a wing section.

6. A toy glider according to claim 5 in which the top rib surface is semi-cylindrical in cross-section.

7. A toy glider according to claim 5 in which some male polygonal corners of each wing root polygon do not have a raised male rib, and are provided with a corner radius, reducing the force required to overcome the tension means to disengage a male polygonal corner having said radius from its mating engagement into its V-shaped channel.

8. A toy glider according to claim 4 in which the wings may be manually re-positioned from a generally horizontal planar flight configuration to a gull-wing flight configuration, to an inverted gull-wing flight configuration, to an extreme upsard position in which the wing tips may touch in the vertical plane above the fuselage, and to an extreme downward position in which the wing tips may touch in the vertical plane below the fuselage.

* * * * *